US006298810B1

(12) United States Patent
Chimonides et al.

(10) Patent No.: US 6,298,810 B1
(45) Date of Patent: Oct. 9, 2001

(54) MOUNTING A COOLING NOZZLE ON AN ENGINE BLOCK

(75) Inventors: Nikos Chimonides, Northants (GB); Gary S. Antcliff, Columbus, IN (US)

(73) Assignees: Cummins Engine Company Ltd., Darlington; Iveco (UK) Ltd., Watford; New Holland U.K. Ltd., Basildon, all of (GB)

( * ) Notice: Subject to any disclaimer, the term of this patent is extended or adjusted under 35 U.S.C. 154(b) by 0 days.

(21) Appl. No.: 09/374,348

(22) Filed: Aug. 13, 1999

(30) Foreign Application Priority Data

Aug. 13, 1998 (GB) ..... 9817530

(51) Int. Cl.[7] ..... F01P 1/04
(52) U.S. Cl. ..... 123/41.35
(58) Field of Search ..... 123/41.35

(56) References Cited

U.S. PATENT DOCUMENTS 4,995,346 * 2/1991 Hudson, Jr. ..... 123/41.35
5,881,684 * 3/1999 Bontaz ..... 123/41.35
5,917,418 * 6/1999 Han ..... 340/686.2

* cited by examiner

*Primary Examiner*—Willis R. Wolfe
*Assistant Examiner*—Katrina B. Harris
(74) *Attorney, Agent, or Firm*—Gary M. Gron

(57) ABSTRACT

The invention relates to an oil nozzle 14 mounted on an engine block 10 to direct oil towards the underside of a reciprocating piston. The oil nozzle 14 consists of an annular mounting collar 16 having a cylindrical outer surface and a tube 38 projecting generally radially from the mounting collar 16. The engine block is formed with a drilled and tapped screw threaded bore 30 that is drilled into the surface of the engine block to intersect an oil gallery 32 in the engine block 10, and with a cylindrical recess 44 that is machined in the surface of the cylinder block 10 surrounding the mouth of the bore 30 to receive and locate the mounting collar 16 of the nozzle 14. A capscrew 28 is inserted through the collar 16 into the threaded bore 30 to retain the collar within the recess, the capscrew allowing oil to flow from the oil gallery in the block into the mounting collar of the oil nozzle.

6 Claims, 2 Drawing Sheets

MOUNTING A COOLING NOZZLE ON AN ENGINE BLOCK

FIELD OF THE INVENTION

The present invention relates to the mounting of a cooling nozzle on an engine block in order to direct a nozzle or spray of oil at the underside of a reciprocating piston.

BACKGROUND OF THE INVENTION

It is known to cool a piston of a heavy duty engine by directing a spray or stream of oil at its underside. For this purpose, a nozzle is secured to the engine block by means of a capscrew and communicates through the capscrew with an oil gallery in the engine block. Conventionally, the capscrew passing through a hole in the base or mounting collar of the nozzle serves as the means for correctly positioning and aligning the nozzle in the block but very accurate machining is required both in the drilling and in the tapping of the bore in the engine block on account of the precision with which it is essential to locate the oil nozzle. In this context, it should be noted that the clearance between the crankshaft, the connecting rod and the piston is typically 5 mm, but it can be as little as 3 mm.

OBJECT OF THE INVENTION

The present invention therefore seeks to provide a mounting of a piston cooling nozzle on the engine block that can reliably achieve accurate alignment positioning of the oil nozzle without resorting to expensive high precision machining and which also ensures that oil can enter the nozzle freely and without obstruction.

SUMMARY OF THE INVENTION

According to the present invention, there is provided a method of mounting an oil nozzle on an engine block, the oil nozzle comprising an annular mounting collar having a cylindrical outer surface and an inner recess in flow communication with a tube projecting generally radially from the mounting collar, the method comprising drilling a bore in the engine block to intersect an oil gallery in the engine block, machining a cylindrical recess in the surface of the cylinder block surrounding the mouth of the bore for receiving and locating the mounting collar of the nozzle, tapping a thread in the bore, placing the mounting collar of the nozzle in the recess and inserting a capscrew through the collar into the threaded bore to retain the collar within the recess, the capscrew allowing oil to flow from the oil gallery in the block into the mounting collar and tube of the oil nozzle.

In accordance with a second aspect of the invention, there is provided an oil nozzle mounted on an engine block to direct oil from an engine oil gallery towards the underside of a reciprocating piston. The oil nozzle comprises an annular mounting collar having a cylindrical outer surface and a tube projecting generally radially from the mounting collar, the annular mounting collar having an interior hole in flow communication with the tube, the engine block is formed with a drilled and tapped screw threaded bore that is drilled into the surface of the engine block to intersect the oil gallery and with a cylindrical recess that is machined in the surface of the cylinder block surrounding the mouth of the bore to receive and locate the mounting collar of the nozzle. A capscrew extends through the collar into the threaded bore to retain the collar within the recess, the capscrew allowing oil to flow from the oil gallery in the block into the mounting collar of the oil nozzle.

BRIEF DESCRIPTION OF THE DRAWINGS

The invention will now be described further, by way of example, with reference to the accompanying drawings, in which.

DETAILED DESCRIPTION OF THE PREFERRED EMBODIMENTS

Figure 1:
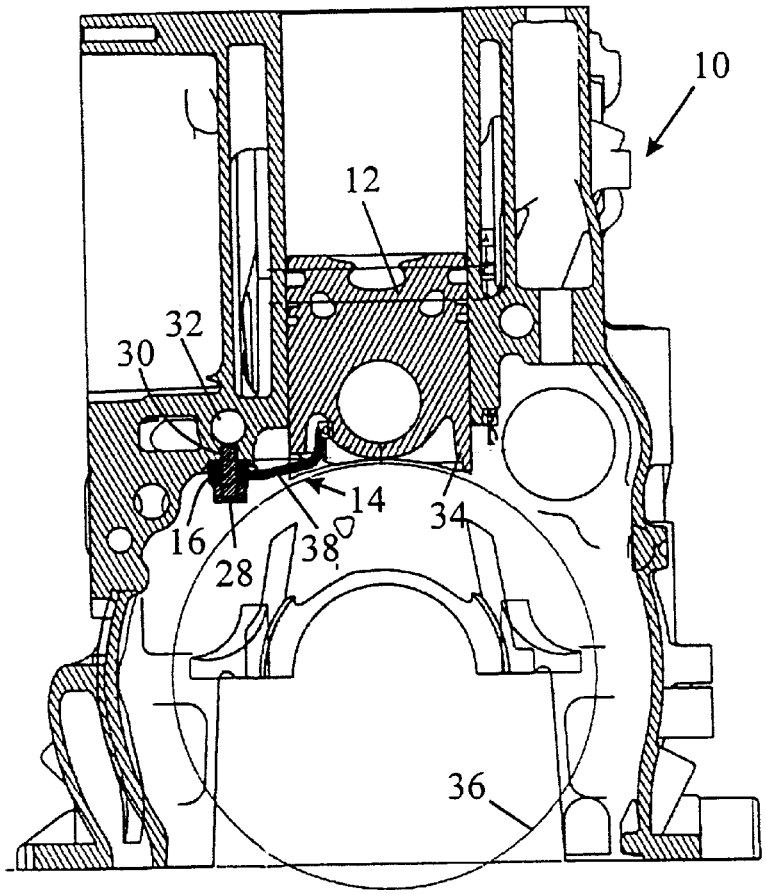
FIG. 1 is a section through an engine block fitted with an cooling nozzle embodying the present invention.
Figure 2:
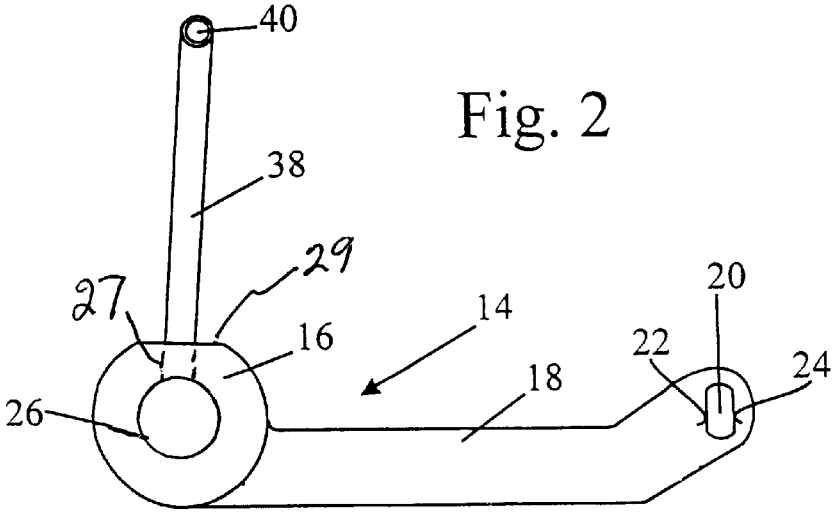
FIG. 2 is a schematic plan view from above of a cooling nozzle.

FIG. 1 shows a section through one cylinder of an engine block 10 with a piston 12 at the bottom of its stroke. The piston 12 is connected via a connecting rod (not shown) to a crankshaft (also not shown) which rotates about axis A. To cool the piston 12, a cooling nozzle, generally indicated by reference numeral 14, sprays oil onto the underside of the piston 12. The cooling nozzle 14, as shown more clearly in FIG. 2, has a base that comprises an annular mounting collar 16 and a radially extending arm 18. A locating pin 20 with two flats 22, 24 projects from the arm 20. A radial passage 27 extends from flat 29 to a central hole 26 and receives a tube 38 which extends generally radially and then is curved to terminate at a nozzle 40 projecting generally in an axial direction relative to the axis of the annular mounting collar 16.

The nozzle 14 is held on the engine block by means of a capscrew 28 that passes through the central hole 26 of the annular collar 16 into a threaded bore 30 that is drilled and tapped in the engine block. The threaded bore 30 extends into an oil gallery 32 or rifle that contains oil pressurised by the engine oil pump. In use, engine oil enters the annular collar 16 and flows through a radial tube 38 to the discharge orifice 40 from which the oil emerges as a jet.

As can clearly be seen from FIG. 1, the space available for the spray nozzle is very restricted and accurate positioning of the nozzle is required if interference is to be avoided with the skirt 34 of the piston 12 and with any part of the crankshaft (not shown), the locus of which is represented by the circle 36 in FIG. 1.

Conventionally, the entire under surface of the engine block 10 on which the cooling nozzles of the pistons are mounted is milled flat and the position of each nozzle 14 is determined by the position of the capscrew 28 that holds it against the engine block. This requires accuracy not only in the drilling but also in the tapping of the bores 30.

Figure 3:
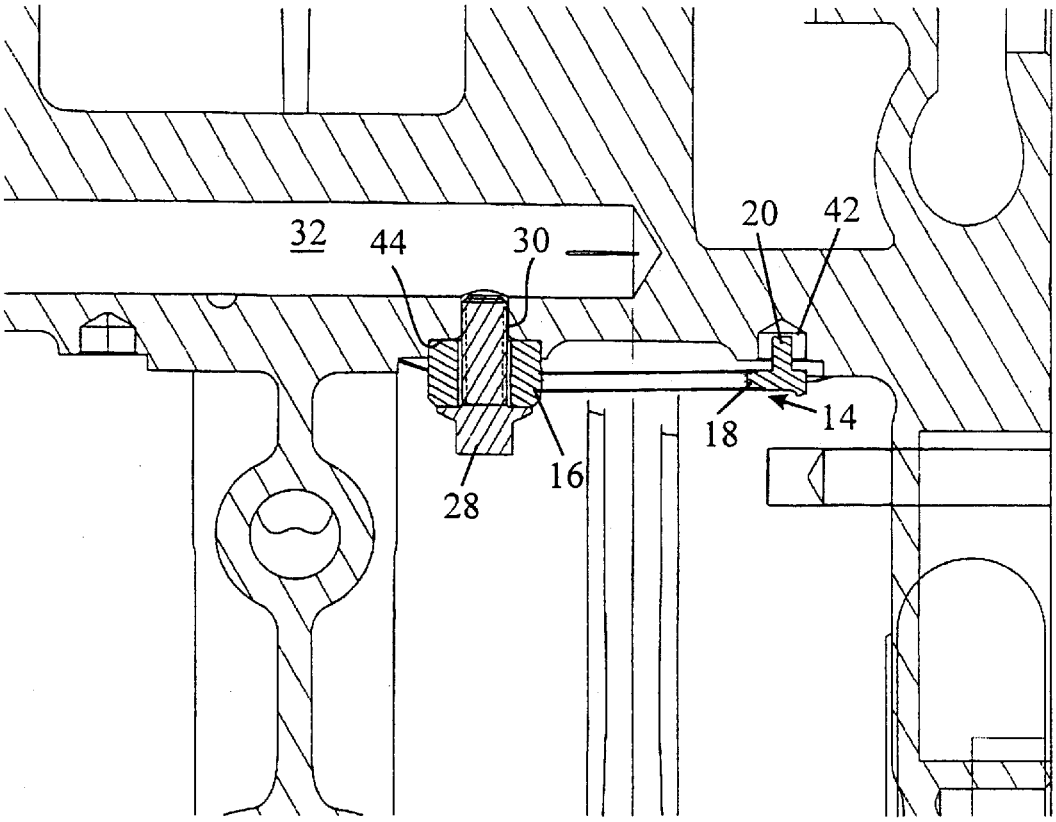
FIG. 3 is a partial section through an engine block showing a cooling nozzle mounted in position.

Referring now to FIG. 3, in the present invention the collar 16 nozzle does not sit on a flat surface but in a cylindrical recess 44 that surrounds the tapped bore 30 that receives the capscrew 28. The cylindrical recess 44 is formed using the same tool as used to drill the bore 30. As is well known, the accuracy with which a bore can be drilled is greater than the accuracy with which one can center a tapped thread. The position of the cylindrical recess can accordingly be fixed with greater accuracy than the axis of the center of the capscrew 28. The position of the annular collar 16 is in turn determined by the cylindrical recess and it can therefore be more accurately located. As the same tool is used to drill the bore 30 and to cut the recess 44, the two are automatically concentric and the sealing surface of the recess 44 is automatically normal to the axis of the bore 30.

To fix the orientation of the base of the nozzle 14, a second shallower hole 42 is drilled in the engine block 10, preferably using the same tool, to receive the pin 20 at the end of the arm 18 of the base of the nozzle 14. Because of the flats 22 and 24 on the pin 20, if the bore 42 has a slightly larger diameter than the pin 20, some tolerance is afforded in the spacing of the bores 30 and 42 without greatly affecting the angular position of the nozzle 14 relative to the engine block 10.

Figure 4:
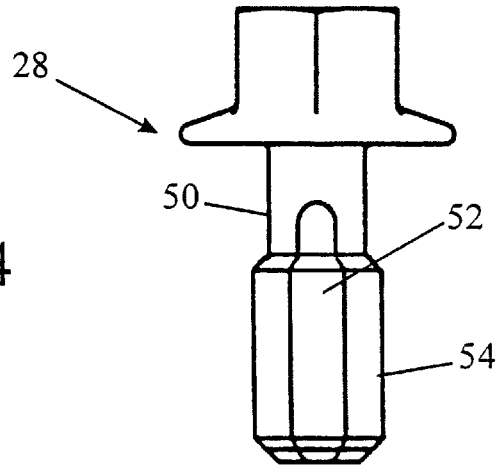
FIG. 4 is a side view of the capscrew used.

As the capscrew 28 was conventionally used to locate the base of the nozzle 14, it had to have an outside diameter equal to that of the central hole 26 in the collar 16. Furthermore it had to be machined to provide a passage through which oil could flow from the oil gallery 32 into the collar of the nozzle. In contrast, the capscrew of the present invention is not used to locate the nozzle so that it can be misaligned with the center of the hole 26. There can and should be a clearance between the stem of the capscrew 28 and the annular collar 16. The capscrew may therefore be as shown in FIG. 4 with the section 50 of the stem located in the collar 16 having a reduced diameter to allow for misalignment and to define an annular gap though which oil can flow to the tube 38 and the discharge orifice 40. The stem of the capscrew 50 may also be formed with one or more axially extending surface grooves 52 that are deeper than the thread 54. These grooves 52 may be formed in the blank of the capscrew and as they are deeper than the thread 54 they will not be affected by the male thread. As a result, the capscrew can be formed simply in a single operation and none of its dimensions is critical to the alignment of the cooling nozzle on the engine block.

In the present invention, the position of the piston cooling nozzle 14 in the engine block 10 is not determined by the location of the threaded bore 30 and the capscrew 28 but by the engagement of the outer surface of the mounting collar 16 of the nozzle in the recess 44 machined in the surface of the engine block surrounding the threaded bore 30. As a result, if a misalignment occurs while tapping the screw thread in the bore, resulting in misalignment of the capscrew, this will not affect the correct positioning of the piston cooling nozzle in the engine block.

Aside from the improved accuracy in the positioning of the piston cooling nozzle in the engine block, the invention provides a cost saving in that conventionally the entire surface of the engine block on which the oil nozzles are mounted needs to be machined flat, whereas in the invention only the cylindrical recesses in which the oil nozzles are mounted need to have machined sealing surfaces.

In a preferred embodiment of the invention, the cylindrical recess 44 and the bore 30 are formed at the same time using a suitably shaped drilling tool. This not only achieves increased cost saving but also ensures that the bore is centered in the cylindrical recess 44 and normal to the surface against which the mounting collar 16 of the piston cooling nozzle 14 seals.

It is further preferred to form the capscrew 28 by providing a blank having one or more axially extending oil grooves in its surface and cutting a thread in the blank that is less deep than the grooves. This allows the formation, in a single machining operation, of a capscrew having grooves through which oil can flow from the gallery in the engine block into the mounting collar 16 of the piston cooling nozzle 14.

In addition to locating the center of the mounting collar 16 of the piston cooling nozzle 14 accurately in relation to the engine block 10, it is necessary to achieve an accurate orientation of the tube of the oil nozzle that extends radially from the mounting collar. In order to achieve this objective, the protruding locating pin 20 on arm 18 is accurately received in a second bore 42 in the engine block 10.

It is convenient to form the second bore 42 of the same diameter as the first bore 44 as this enables the same drilling spindle to be used for both bores. Advantageously, the pin 20 is formed with two diametrically opposed flats 22, 24 to allow some tolerance in the spacing between the two bores in the block without affecting the orientation of the oil nozzle in the engine block.

Having thus described the invention, what is novel and desired to be secured by Letters Patent of the United States is:

1. An oil nozzle for mounting on an engine block having an oil gallery to direct oil towards the underside of a reciprocating piston, comprising an annular mounting collar having a cylindrical outer surface and a tube projecting generally radially from the mounting collar, said annular mounting collar having an interior hole in flow communication with said tube, said engine block being formed with a drilled and tapped screw threaded bore that is drilled into the surface of the engine block to intersect said oil gallery, and with a cylindrical recess that is machined in the surface of the cylinder block surrounding the mouth of the bore to receive and locate the mounting collar of the nozzle, and a capscrew extending through said collar into the threaded bore to retain the collar within the recess, the capscrew allowing oil to flow from the oil gallery in the block into the mounting collar of the oil nozzle.

2. Apparatus as claimed in claim 1, wherein the cylindrical recess and the bore are formed at the same time.

3. Apparatus as claimed in claim 2 wherein said capscrew has a threaded stem with a section of reduced diameter and oil grooves extending axially in the surface of the stem from the reduced diameter section through the thread to the free end of the capscrew whereby oil is communicated from said oil gallery to said interior hole.

4. Apparatus as claimed in claim 3, further comprising an arm extending generally radially from the mounting collar and a protruding locating pin, wherein a second bore is formed in the engine block to receive said locating pin.

5. Apparatus as claimed in claim 4, wherein the second bore is formed of the same diameter as the first bore and is drilled using the same tool as the first bore.

6. Apparatus as claimed in claim 5, wherein the pin has two flats oriented generally at right angles to the longitudinal axis of said arm so as to increase the tolerance of the distance between the bores drilled in the engine block.

* * * * *